US008354905B2

(12) United States Patent
Eum

(10) Patent No.: US 8,354,905 B2
(45) Date of Patent: Jan. 15, 2013

(54) NOISE DECREASING TYPE ELECTROMAGNETIC SWITCH

(75) Inventor: Young Hwan Eum, Chungbuk (KR)

(73) Assignee: LSIS Co., Ltd., Anyang, Gyeonggi-Do (KR)

( * ) Notice: Subject to any disclaimer, the term of this patent is extended or adjusted under 35 U.S.C. 154(b) by 0 days.

(21) Appl. No.: 13/272,149

(22) Filed: Oct. 12, 2011

(65) Prior Publication Data

US 2012/0092101 A1 Apr. 19, 2012

(30) Foreign Application Priority Data

Oct. 15, 2010 (KR) ..... 10-2010-0100792

(51) Int. Cl.
*H01H 3/00* (2006.01)

(52) U.S. Cl. ..... 335/193; 335/126

(58) Field of Classification Search ..... 335/78, 335/128, 185, 193, 220, 271, 277
See application file for complete search history.

(56) References Cited

U.S. PATENT DOCUMENTS

| | | | | |
|---|---|---|---|---|
| 7,535,328 | B2 * | 5/2009 | Kurasawa et al. | 335/281 |
| 7,591,281 | B2 * | 9/2009 | Tsuge | 137/495 |
| 7,876,183 | B2 * | 1/2011 | Uruma et al. | 335/126 |

FOREIGN PATENT DOCUMENTS

| | | |
|---|---|---|
| EP | 0798752 | 10/1997 |
| EP | 1953784 | 8/2008 |

* cited by examiner

*Primary Examiner* — Bernard Rojas
(74) *Attorney, Agent, or Firm* — Lee, Hong, Degerman, Kang & Waimey

(57) ABSTRACT

A noise decreasing type electromagnetic switch includes a buffer disposed between an end of a stationary core and an end of a movable core facing the end of the stationary core so as to allow the movable core 150 to be elastically supported with respect to the stationary core. Accordingly, when the movable core contacts the stationary core, the buffer can be pressed and transformed to decrease impact and noise. Also, when the final operation is completed, the stationary core and the movable core are closely adhered, a performance of an actuator can be maintained.

9 Claims, 4 Drawing Sheets

NOISE DECREASING TYPE ELECTROMAGNETIC SWITCH

CROSS-REFERENCE TO RELATED APPLICATION

This application claims the benefit of earlier filing date and right of priority to Korean Patent Application No. 10-2010-0100792, filed on Oct. 15, 2010, which is hereby incorporated by reference herein in its entirety.

BACKGROUND OF THE INVENTION

1. Field of the Invention

This specification relates to a noise decreasing type electromagnetic switch capable of noise generated between a stationary core and a movable core.

2. Background of the Invention

In general, an electromagnetic switch is located between a battery and a direct current (DC) power converter of an electric vehicle, such as a hybrid car, a fuel cell car, an electric golf cart, an electric forklift truck and the like, and serves to supply power of the battery to the power converter, and supply power generated from a power generator to the battery.

The electromagnetic switch includes a coil which is excited (magnetized) or demagnetized according to whether or not a control current flows, a yoke installed adjacent to the coil to define (form) a magnetic path adjacent to the coil, a metal plate installed to face the yoke and defining the magnetic path adjacent to the coil together with the yoke, a stationary core fixed to the metal plate, a movable core installed to face the stationary core, and movably installed to contact the stationary core when the coil is excited and to be separated from the stationary core when the coil is demagnetized, a shaft having one end portion coupled to the movable core and movable together with the movable core, and a return spring located between the stationary core and the movable core and having a larger elastic force than contact pressure of a contact spring such that the movable core is separated from the stationary core.

In the structure of the related art electromagnetic switch, when a magnetic field is formed in response to power being applied to the coil, the movable core is attracted toward the stationary core, and an upper conductive portion is run by the shaft connected to the movable core. However, impact noise is generated while the movable core contacts the stationary core, thereby causing degradation of a perceived quality of a product.

SUMMARY OF THE INVENTION

Therefore, an aspect of the detailed description is to provide a noise decreasing type electromagnetic switch, capable of decreasing impact noise between movable and stationary cores, which may occur when those cores contact each other, by virtue of installation of a buffer therebetween, and making the movable and stationary cores closely adhered to each other without an air gap therebetween upon completion of the final operation.

To achieve these and other advantages and in accordance with the purpose of this specification, as embodied and broadly described herein, a noise decreasing type electromagnetic switch may include a stationary core, a movable core alternatively contactable with the stationary core, a return spring disposed between the movable core and the stationary core to apply an elastic force such that the movable core is separated from the stationary core, a shaft connected to the movable core to be movable together with the movable core, a movable contact point coupled to the shaft to be movable together with the shaft, a stationary contact point fixed to face the movable contact point and contactable with or separated from the movable contact point such that an electric circuit is closed or open, and a contact spring configured to elastically support the movable contact point to contact the stationary contact point, wherein a buffer is disposed between an end of the stationary core and an end of the movable core facing the end of the stationary core to allow the movable core to be elastically supported with respect to the stationary core.

In accordance with another exemplary embodiment, there is provided a noise decreasing type electromagnetic switch including a stationary core, a movable core alternatively contactable with the stationary core, a return spring disposed between the movable core and the stationary core to apply an elastic force such that the movable core is separated from the stationary core, a shaft connected to the movable core to be movable together with the movable core, a movable contact point coupled to the shaft to be movable together with the shaft, a stationary contact point fixed to face the movable contact point and contactable with or separated from the movable contact point such that an electric circuit is closed or open, and a contact spring configured to elastically support the movable contact point to contact the stationary contact point, wherein a stepped concave portion is formed at an outer circumferential surface of at least one of an end of the stationary core and an end of the movable core facing the end of the stationary core, wherein a buffer in an annular shape having flexibility in a motion direction of the movable core is coupled to the concave portion.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the detailed description.

BRIEF DESCRIPTION OF THE DRAWINGS

The accompanying drawings, which are included to provide a further understanding of the invention and are incorporated in and constitute a part of this specification, illustrate exemplary embodiments and together with the description serve to explain the principles of the invention.

In the drawings.

DETAILED DESCRIPTION OF THE INVENTION

Description will now be given in detail of a noise decreasing type electromagnetic switch according to the exemplary embodiments, with reference to the accompanying drawings. For the sake of brief description with reference to the drawings, the same or equivalent components will be provided with the same reference numbers, and description thereof will not be repeated.

Figure 1:
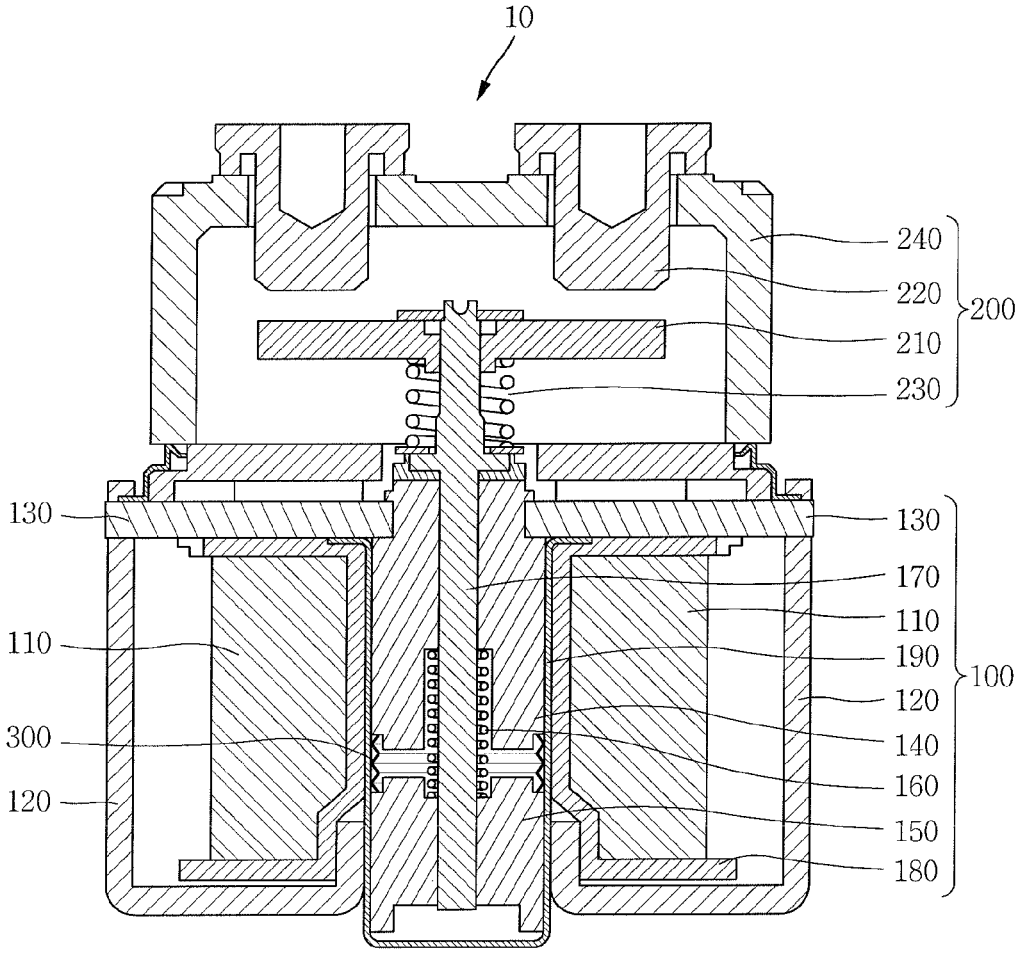
FIG. 1 is a sectional view showing an open state of a noise decreasing type electromagnetic switch in accordance with one exemplary embodiment.
Figure 2:
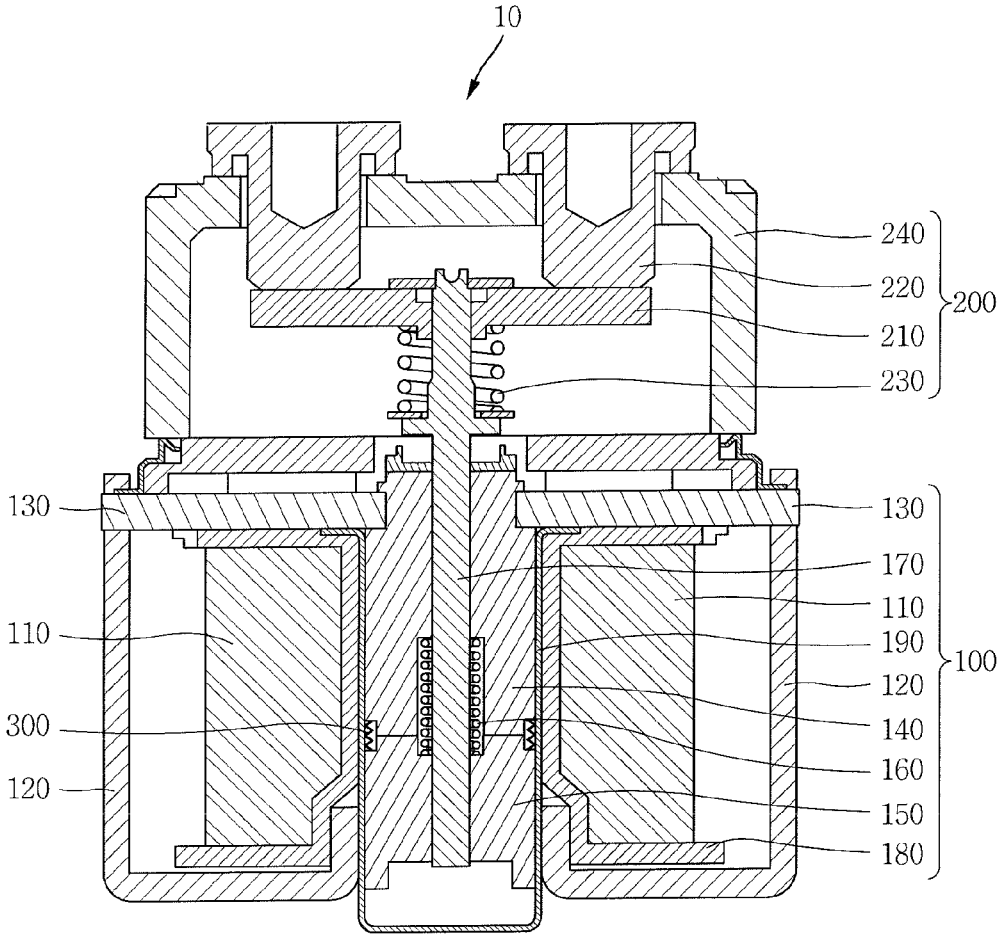
FIG. 2 is a sectional view showing a closed state of the noise decreasing type switch.
Figure 3:
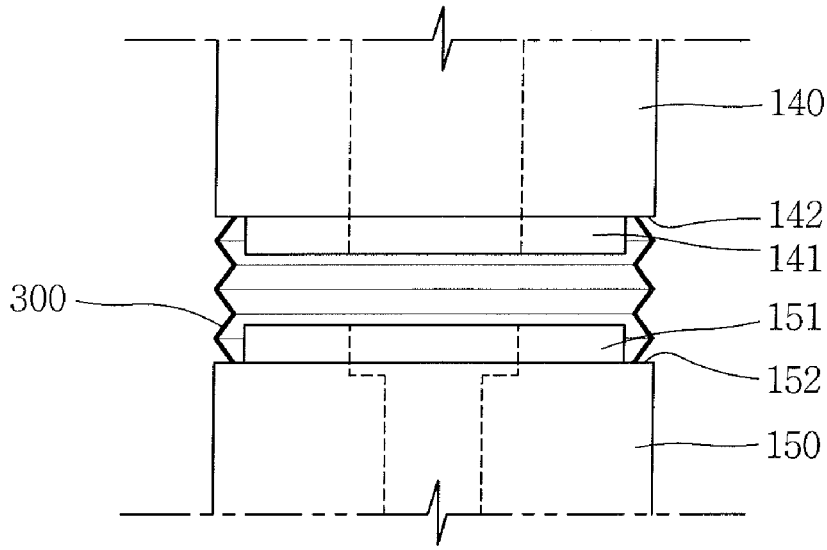
FIG. 3 is a side view showing a stationary core and a movable core in accordance with the one exemplary embodiment.
Figure 4:
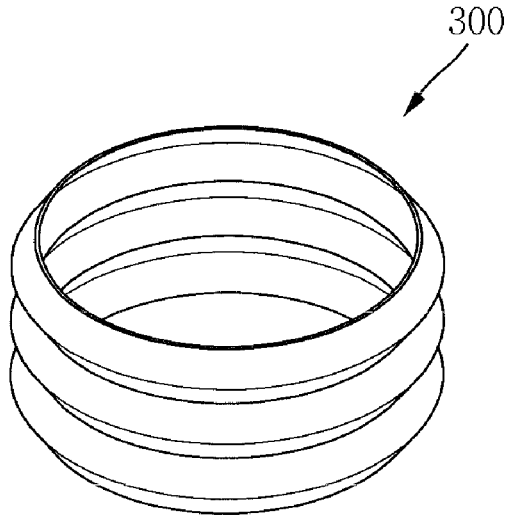
FIG. 4 is a perspective view of a buffer in accordance with the one exemplary embodiment.

FIG. 1 is a sectional view showing an open state of a noise decreasing type switch in accordance with one exemplary embodiment, FIG. 2 is a sectional view showing a closed state of the noise decreasing type switch, FIG. 3 is a side view showing a stationary core and a movable core in accordance with the one exemplary embodiment, and FIG. 4 is a perspective view of a buffer in accordance with the one exemplary embodiment.

As shown in FIGS. 1 and 2, a noise decreasing type electromagnetic switch 10 may include a driving unit 100, and a conducting unit 200 switched on or off with respect to the exterior with moving up and down by the driving unit 100. The conducting unit 200 may have a contact-point switching structure which includes a stationary contact point 220 and a movable contact point 210 so as to allow switching with respect to an external device connected to the electromagnetic switch 10.

The driving unit 100 may control contact or non-contact between the contact points using an electric signal. The driving unit may include a coil 110 for generating driving forces of the contact points by a magnetic force generated by the electric signal, a yoke 120 installed adjacent to the coil 110 to form a magnetic path adjacent to the coil 110, a stationary core 140 fixed within the coil 110, and a movable core 150 disposed to face the stationary core 140.

A coil bobbin 180, on which the coil 110 is wound, may be located between the coil 110 and the stationary core 140 and the movable core 150. The stationary core 140 and the movable core 150 may be disposed in a longitudinal direction based on an axial direction of the coil bobbin 180. The stationary core 140 and the movable core 150 may form a magnetic path, through which magnetic flux generated by the coil 110 flows. The magnetic flux generated by the coil 110 may make the movable core 150 moved up and down.

A core case 190 may be located between the coil bobbin 180 and the stationary and movable cores 140 and 150. The core case 190 may be formed of a non-magnetic material and be in a cylindrical shape having an opening at a surface facing the conducting unit 200 and a bottom of an opposite surface blocked. That is, the core case 190 may have a shape like a case for accommodation of the stationary core 140 and the movable core 150 therein, and be formed in a cylindrical shape with an inner diameter, which is approximately the same as the outer diameter of each of the stationary core 140 and the movable core 150. The movable core 150 may be movable in an axial direction of the core case 190.

The movable core 150 may be movable in the range between a position of being contactable with the stationary core 140 and an initial position where the movable core 150 is separated from the bottom of the opposite surface of the core case 190. The movable core 150 may be contactable with the stationary core 140 by a contact spring 230 to be explained later and return to its original position by a return spring 160 to be explained later.

A through hole may be formed through central portions of the stationary core 140 and the movable core 150 in an axial direction. A shaft 170 may be inserted through the through hole so as to connect the driving unit 100 and the conducting unit 200 to each other. The shaft 170 may be coupled with the movable contact point 210 at its upper end and the movable core 150 at its lower end so as to transfer a longitudinal motion of the movable core 150 to the movable contact point 210.

A cover 240 may be coupled to the driving unit 100 by being loaded on the driving unit 100. The cover 240 may be box-shaped with an open lower side. Terminal holes (reference numeral not given) for insertion of the stationary contact point 220 and a fixing terminal therein may be formed at an upper portion of the cover 240.

The movable contact point 210 coupled to the shaft 170 below the stationary contact point 220 may be disposed within the cover 240. A space for performing contact and separation between the stationary contact point 220 and the movable contact point 210 for a switching operation may be present between the stationary contact point 220 and the movable contact point 210 within the cover 240.

The contact spring 230 may be disposed at a lower side of the movable contact point 210. The contact spring 230 may have an elastic force when the movable contact point 210 contacts the stationary contact point 220. The contact spring 230 may allow the movable contact point 210 to remain in the contact state with the stationary contact point 220 by pressure more than a preset level. Also, when the movable contact point 210 is separated from the stationary contact point 220, the contact spring 230 may reduce a movement speed of each movable core 150 and shaft 170. Consequently, when the movable core 150 contacts the core case 190, an impact may be relieved to minimize or prevent generation of noise and vibration.

The movable contact point 210, which is movable in response to movement of the shaft 170, may be coupled to another end of the shaft 170, and the stationary contact point 220 may be fixed above the movable contact point 210 to face the movable contact point 210. As the stationary contact point 220 contacts or is separated from the movable contact point 210, an electric circuit is closed or open.

The contact spring 230 for providing an elastic force to the movable contact point 210 to contact the stationary contact point 220 may be installed at the lower side of the movable contact point 210 at the periphery of the shaft 170.

With the configuration of the electromagnetic switch 10, when a magnetic field is formed in response to power being applied to the coil 110, the movable core 150 is attracted toward the stationary core 140, the upper conducting unit 200 is run by the shaft 170 connected to the movable core 150. Here, the movable core 150 contacts the stationary core 140, thereby generating impact noise, which may lower a perceived quality of a product.

To address such problem, an elastic member in form of a flat plate may be mounted between the movable core and the stationary core so as to decrease noise generated when the movable core contacts the stationary core. However, when the elastic member in the form of the flat plate is employed, noise may be decreased but an air gap is generated between the stationary core and the movable core in the operation-completed state, which may result in a decrease of performance of an actuator and an increase in power consumption.

Therefore, this exemplary embodiment aims to closely adhering the stationary core and the movable core without an air gap therebetween in the operation-completed state as well as reducing impact and noise, in a manner that the elastic member is pressed and transformed when the movable core contacts the stationary core.

To this end, the electromagnetic switch 10 may have a structure that a buffer 300 in form of a bellows is fixed to side walls of the stationary core 140 and the movable core 150. For example, as shown in FIGS. 3 and 4, concave portions 141 and 151 may be formed by being concaved inwardly at respective outer side walls of a lower side of the stationary core 140 and an upper side of the movable core 150, which are closely adhered to each other, so as to form stepped portions 142 and 152. Accordingly, the buffer 300 may be fixedly inserted between the stepped portions 142 and 152. Hence, the buffer 300 may be fixedly inserted into the concave portions 141 and 151 such that both end portions of the buffer 300 can be supported by the stepped portions 142 and 152.

The buffer 300 may have the form of the bellows having consecutive folded (bent) portions alternately folded (bent) in and out. Consequently, the buffer 300 may have a restoration force to be automatically unfolded to its original state from a folded state caused by an external force when the external force is not applied any more. Therefore, the bellows is pressed in a folding manner when the movable core 150 contacts the stationary core 140. When the movable core 150 is separated from the stationary core 140, the folded bellows is unfolded as much as the separated distance between the movable core 150 and the stationary core 160 so as to be lengthened. Such series of processes are repeated.

Hereinafter, description will be given of a buffer according to another exemplary embodiment.

Figure 5:
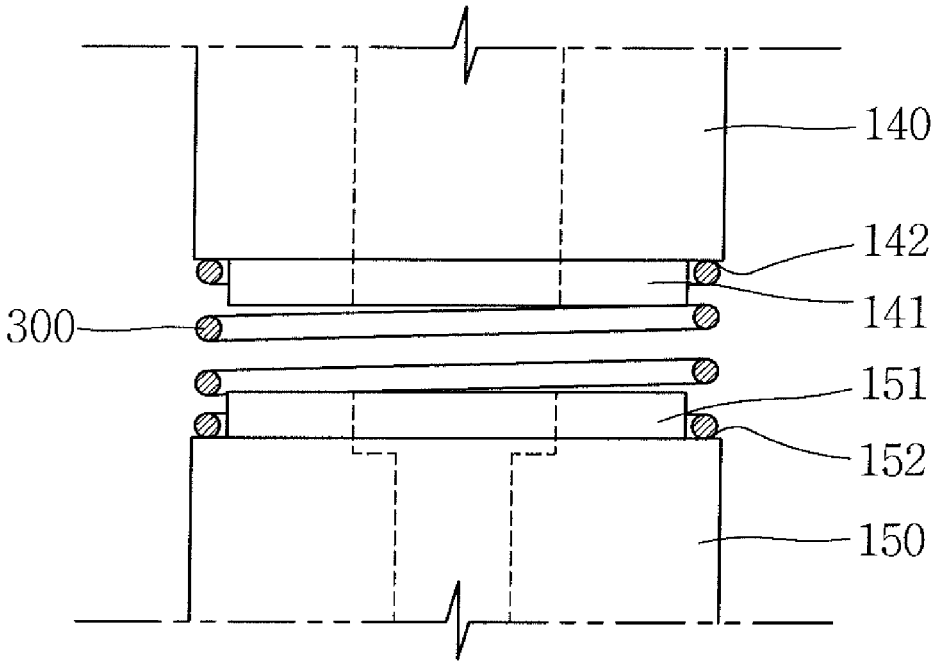
FIG. 5 is a side view showing a stationary core and a movable core in accordance with another exemplary embodiment.

That is, the foregoing exemplary embodiment illustrates that the buffer has the form like the bellows, but this another exemplary embodiment, as shown in FIG. 5, illustrates that the buffer 300 is implemented as a compression coil spring. Here, stepped concave portions 141 and 151 may be formed respectively at outer circumferential surfaces that the stationary core 140 and the movable core 150 face each other, and the buffer 300 may be inserted between the stepped concave portions 141 and 151.

Even when the compression spring coil is used as the buffer, the operational effect may be similar to or the same as that obtained in the previous embodiment, so detailed description thereof will be omitted. Although not shown, the buffer may be formed of a flexible material in an annular shape, which is flexible in a motion direction of the movable core.

Meanwhile, in some cases, the concave portion may be formed only at one of an end of the stationary core or an end of the movable core. Here, the concave portion may preferably be formed at the movable core located relatively at a lower side.

Accordingly, when the movable core contacts the stationary core, the buffer may be pressed and transformed so as to reduce impact and noise. Also, in the operation-completed state, the stationary core and the movable core may be closely adhered to each other so as to maintain the performance of an actuator.

The foregoing embodiments and advantages are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A noise decreasing type electromagnetic switch comprising:

a stationary core;

a movable core alternatively contactable with and separable from the stationary core;

a return spring disposed between the movable core and the stationary core to apply an elastic force such that the movable core is separated from the stationary core;

a shaft connected to the movable core and movable together with the movable core;

a movable contact point coupled to the shaft and movable together with the shaft;

a stationary contact point fixed to face the movable contact point and contactable with and separable from the movable contact point such that an electric circuit is closed or open;

a contact spring configured to elastically support the movable contact point to contact the stationary contact point; and a buffer disposed between an end of the stationary core and an end of the movable core and facing the end of the stationary core to elastically support the movable core with respect to the stationary core, wherein the buffer is formed as a bellows, a first end of the bellows coupled to the end of the stationary core and a second end of the bellows coupled to the end of the movable core, wherein the bellows comprises consecutive folded or bent portions surrounding an inner space between the first and second ends of the bellows, wherein stepped concave portions are formed at an outer circumferential surface of the end of the stationary core and the corresponding outer circumferential surface of the end of the movable core, and wherein the bellows is fixedly inserted between the outer circumferential surfaces of the stationary core and movable core such that the concave portions of the stationary core and movable core protrude partially into the inner space of the bellows.

2. The switch of claim 1, wherein the buffer is implemented as a compression coil spring, one end of the buffer being coupled to the end of the stationary core and another end thereof being coupled to the end of the movable core.

3. The switch of claim 2, wherein stepped concave portions are formed at an outer circumferential surface of the end of the stationary core and the corresponding outer circumferential surface of the end of the movable core, respectively, such that both ends of the buffer are fixedly inserted therebetween.

4. The switch of claim 1, further comprising a coil excited or demagnetized according to whether or not a control current flows.

5. The switch of claim 4, further comprising a yoke installed adjacent to the coil to form a magnetic path adjacent to the coil.

6. A noise decreasing type electromagnetic switch comprising:

a stationary core;

a movable core alternatively contactable with and separable from the stationary core;

a return spring disposed between the movable core and the stationary core to apply an elastic force such that the movable core is separated from the stationary core;

a shaft connected to the movable core and movable together with the movable core;

a movable contact point coupled to the shaft and movable together with the shaft;

a stationary contact point fixed to face the movable contact point and contactable with or separable from the movable contact point such that an electric circuit is closed or open;

a contact spring configured to elastically support the movable contact point to contact the stationary contact point; and a buffer having an annular shape that is flexible in a motion direction of the movable core coupled to an end of the stationary core and an end of the movable core, wherein the buffer is formed as a bellows, a first end of the bellows coupled to the end of the stationary core and a second end of the bellows coupled to the end of the movable core, wherein the bellows comprises consecutive folded or bent portions surrounding an inner space between the first and second ends of the bellows;

wherein stepped concave portions are formed at an outer circumferential surface of the end of the stationary core and the corresponding outer circumferential surface of the end of the movable core that faces the end of the stationary; and wherein the bellows is fixedly inserted between the outer circumferential surfaces of the stationary core and movable core such that the concave portions of the stationary core and movable core protrude partially into the inner space of the bellows.

7. The switch of claim 6, wherein the buffer is implemented as a compression coil spring, at least one end of the buffer being coupled to the end of the stationary core or the end of the movable core.

8. The switch of claim 6, further comprising a coil excited or demagnetized according to whether or not a control current flows.

9. The switch of claim 8, further comprising a yoke installed adjacent to the coil to form a magnetic path adjacent to the coil.

* * * * *